United States Patent [19]

Saitou et al.

[11] Patent Number: 5,032,236

[45] **Date of Patent: * Jul. 16, 1991**

[54] PROCESS FOR PRODUCING A SURFACE-BLACKENED STEEL SHEET

[75] Inventors: Katsushi Saitou; Yuujirou Miyauchi; Kazumi Shibata; Kouichi Wada, all of Chiba, Japan

[73] Assignee: Nippon Steel Corporation, Tokyo, Japan

[ * ] Notice: The portion of the term of this patent subsequent to Aug. 29, 2006 has been disclaimed.

[21] Appl. No.: 541,733

[22] Filed: Jun. 21, 1990

[30] Foreign Application Priority Data

Jun. 22, 1989 [JP] Japan ..... 1-158332

[51] Int. Cl.[5] ..... C25D 7/06; C25D 5/00; C25D 11/38

[52] U.S. Cl. ..... 204/27; 204/38.7; 204/56.1

[58] Field of Search ..... 204/15, 38.1, 38.7, 204/44.2, 27, 56.1

[56] References Cited

U.S. PATENT DOCUMENTS 4,749,449 6/1988 Scott ..... 204/15
4,861,441 8/1989 Saito et al. ..... 204/44.2
4,968,391 11/1990 Saito et al. ..... 204/56.1

FOREIGN PATENT DOCUMENTS 60-190588 9/1985 Japan .
63-50499 3/1988 Japan .
63-65086 3/1988 Japan .
1-195286 8/1989 Japan .

*Primary Examiner*—John F. Niebling
*Assistant Examiner*—Kishor Mayekar
*Attorney, Agent, or Firm*—Wenderoth, Lind & Ponack

[57] ABSTRACT

A surface-blackened steel sheet is produced by electrolyzing a steel sheet at a cathode in an acidic aqueous solution containing $Zn^{2+}$, at least one of $Fe^{2+}$, $Co^{2+}$ and $Ni^{2+}$, a film-improving ion consisting of at least one member selected from the group consisting of $Cr^{3+}$, $Fe^{2+}$, $Pb^{2+}$, $In^{2+}$, $Ag^{2+}$, $Sn^{2+}$, $Ti^{2+}$, $Al^{3+}$, $Cu^{2+}$, $Mo^{6+}$, $V^{3+}$, $V^{6+}$, $Mn^{2+}$, $Mn^{4+}$, $Mn^{6+}$, $Bi^{2+}$, sulfite ion, thiosulfate ion, thiocyanate ion, sulfamate ion and sulfonate ion, an oxidizing ion and an organic hydroxy-compound as main components, thereby forming a black film on the steel sheet, followed by water washing, a chromate treatment, if required, and coating with a guard coat.

22 Claims, No Drawings

PROCESS FOR PRODUCING A SURFACE-BLACKENED STEEL SHEET

BACKGROUND OF THE INVENTION

1.) Field of the Invention

This invention relates to a process for producing a surface-blackened steel sheet applicable to ornament-requiring members. The term "steel sheet" as used hereinafter means at least one of "steel sheet", "steel plate" and/or "steel strip". A steel sheet having a large size in the longitudinal direction is called "steel strip" and it is wound to have a state of a coil.

2.) Prior Art

Developments of surface-treated steel sheets having distinguished properties at a low cost are in incessant need in the field of rust-proof steel sheets for automobiles, domestic electrical appliances, furnitures, and architectural materials, and the need has been shifted toward lower cost and higher quality year by year. Steel manufacturers have been responded to the need imposed by users by developing new technology and new products. The conventional surface-treated steel sheets are worked, pretreated and coated, thereby obtaining products. On the other hand, recently, movements of converting the conventional products into products fabricated from precoated steel sheets have been very active, because products of higher quality can be obtained at a lower cost without the pretreatment and coating so far carried out on the users' side. To this end, precoated steel sheets, that is, steel sheets coated with a paint in advance, have been used, and recently need for steel sheets colored with an inorganic material has been keen from the viewpoints of more drastic cost reduction, appearance of higher grade, better weldability, and less occurrence of handling scratches.

Above all, need for black color tone is stronger because of less attachment of finger prints, and higher workability, chemical resistance and corrosion resistance besides the afore-mentioned merits.

The conventional surface-blackening process is generally directed to stainless steel sheets, steel sheets and copper sheets, but galvanized (zinc-plated) steel sheets are suitable for the objects of the present invention in view of the cost and the corrosion resistance. Thus, the conventional surface-blackening technique thereof will be explained below.

The following techniques are well known as surface-blackening processes by cathodic electrolysis of galvanized or zinc alloy plated steel sheets in connection with the present invention.

Japanese Patent Application Kokai (Laid-open) No. 60-190588 discloses a process for surface-blackening a galvanized or zinc alloy plated steel sheet by electrolyzing a galvanized or zinc alloy plated steel sheet as a cathode in an aqueous solution containing $Co^{2+}$ and/or $Ni^{2+}$, at least one of alkali metal salt of sulfuric acid, nitric acid, hydrochloric acid, phosphoric acid, carbonic acid, etc. and ammonium salt thereof, and further, if required, at least one of alkali metal salt of tellurous acid and telluric acid and ammonium salt thereof and/or at least one of alkali metal salt of formic acid, tartaric acid, citric acid, thiocyanic acid, thiosulfuric acid, and hypophophorous acid and/or ammonium salt thereof at a pH of 2 to 11 and a current density of 1 to 50 $A/dm^2$ for 0.5 to 30 seconds, thereby depositing a black complex metal plating.

In case of the Japanese Patent Application Kokai (Laid-open) No. 60-190588, the present inventors have found by experiments that the blackening can be obtained in an ideal state in a laboratory-scale, stationary bath, but cannot be applied to a process for treating a wide steel strip at a high speed, as aimed at in the present invention, because of development of uneven plating appearance.

That is, the process disclosed in the Japanese Patent Application Kokai (Laid-open) No. 60-190588 requires a prolonged electrolysis at a low current density in order to blacken the surface uniformly, and also the bath conditions for the surface blackening are in a narrow range. Thus, the disclosed process is not applicable to continuous treatment of a wide coiled steel sheet at a high speed, as aimed at in the present invention, and is practically applied only to specific alloy plating by anodic oxidation and etching with an oxidizing acid such as nitric acid, etc. In other words, cathodic electrolysis has not been practically used yet.

In order to solve these problems, the present inventors developed the following two process, as surface-blackening processes which use a zinc alloy plating bath containing an oxidizing ion and which are capable of blackening almost all of metals.

Japanese Patent Application Kokai (Laid-open) No. 63-50499 discloses a process for producing a colored zinc complex plated steel sheets by electrolyzing a steel sheet or a plated steel sheet as a cathode in an aqueous solution containing $Zn^{2+}$, at least one of coloring metal ion such as $Ni^{2+}$, $Co^{2+}$, $Fe^{2+}$, $Fe^{3+}$, $Cr^{3+}$, $Sn^{2+}$ and $Cu^{2+}$ and at least one of strongly oxidizing ion such as $NO_3^-$, $NO_2^-$, $ClO_4^-$ and $ClO_3^{2-}$, thereby plating a colored complex metal, followed by water washing, a chromate treatment, if required, and coating with a guard coat.

Japanese Patent Application Kokai (Laid-open) No. 63-65086 discloses a process for producing a surface-blackened steel sheet by electrolyzing a steel sheet or a plated steel sheet as a cathode in an acidic aqueous solution containing $Zn^{2+}$, at least one of $Fe^{2+}$, $Co^{2+}$, $Ni^{2+}$ and $Cr^{3+}$, at least one of oxidizing ion such as $NO_3^-$, $NO_2^-$, $ClO_4^-$ and $ClO_3^-$ and condensed phosphoric acid compound capable of supplying condensed phosphate ion such as $P_2O_7^{4-}$, $P_3O_{10}^{5-}$, $P_4O_{13}^{6-}$ and $P_6O_{19}^{8-}$ as main components, thereby plating a black film, followed by a chromate treatment, if required, and coating with a guard coat.

SUMMARY OF THE INVENTION

Still furthermore, the present inventors have found an improved process of these two processes and filed the process as a patent application (=Japanese Patent Application No./Shouwa/63-17467, filed on Jan. 29, 1988 and laid open on Aug. 7, 1989 with Kokai (Laid-open No.Hei-Sei 1-195286). The process is directed to production of a surface-blackened steel sheet by electrolyzing a steel sheet or a plated steel sheet as a cathode in an acidic aqueous solution containing $Zn^{2+}$, at least one of $Fe^{2+}$, $Co^{2+}$ and $Ni^{2+}$, at least one of film-improving ion such as $Cr^{3+}$, $Fe^{2+}$, $Pb^{2+}$, $Ag^{2+}$, $Sn^{2+}$, $Ti^{2+}$, $Al^{3+}$, $Cu^{2+}$, $Cr^{6+}$, $Mo^{6+}$, $V^{6+}$, $Mn^{6+}$ and $Bi^{2+}$, if required, and at least one of oxidizing ion such as $NO_3^-$, $NO_2^-$, $ClO_4^-$ and $ClO_3^-$ and at least one of thio compound such as thiosulfurous acid ($H_2S_2O_2$) and its salt, thiosulfuric acid ($H_2S_2O_3$) and its salt, thiocyanic acid (HSCN) and its salt, thiocarbonic acid ($H_2CS_3$) and its salt, and compound containing -SH or -SR such as thio-sugar ($C_6O_5H_{11}SH$), thiophene ($H_4C_4S$), thiourea [$SC(NH_2)_2$], thiophenol ($C_6H_5SH$), and thiophthene ($C_6H_4S_2$) as main component, followed by water washing, a chromate treatment, if required, and coating with a guard coat.

The black film can be obtained even by any of the above-mentioned processes, but in a continuous treatment, polyvalent metal ion oxidized at the anode gives rise to poor appearance or to a failure to obtain the desired tight adhesion.

That is, when a cathodic treatment process is applied to a continuous line of a wide galvanized or zinc alloy plated steel sheet, tin plated steel sheet or the like, it encounters problems, for example, contamination of impurity ions, influence due to fluctuation in the bath temperature and pH, changes in the current density, uneven plating due to generation of hydrogen gas, differences in the activity on the plating surface, damage due to contact with rolls, reaction with post-treatments, etc. However, a cathodic treatment process, which has a wide allowance for these problems thus encountered and which is applicable to the continuous use and suitable for the mass production, has not yet been found.

The present inventors have made further extensive studies of bath composition to solve these problems and have found a cathodic treatment process having a wide allowance for these problems and being applicable to the continuous use.

An object of the present invention is to provide an improved cathodic electrolytic treatment process that can meet requirements for improving the quality and productivity of products.

Another object of the present invention is to provide a process for producing a surface-blackened steel sheet applicable to the conventional field of coated steel sheets as a novel steel sheet having a distinguished appearance, workability, corrosion resistance and scratch resistance on the quality side and contributable to grade-up and cost reduction of products on the production side.

Other object of the present invention is to provide a low-cost process for producing a surface-blackened steel sheet at a high speed for a short time under a wide range of treatment conditions, which is applicable to the conventional electroplating line.

Further object of the present invention is to provide a process for producing a surface-blackened steel sheet having more advantages in the independency of blackening upon a matrix metal and in readily blackening a large surface area with a small quantity of electricity, as compared with the conventional alloy plating process or alloy fusion process.

The above-mentioned objects of the present invention can be attained by:

(1) A process for producing a surface-blackened steel sheet, which comprises electrolyzing a steel sheet or a plated steel sheet as a cathode in an acidic aqueous solution containing $Zn^{2+}$, at least one of $Fe^{2+}$, $Co^{2+}$ and $Ni^{2+}$, an oxidizing ion and an organic hydroxycompound (an oxycompound) as main components, thereby forming a black film on the steel sheet, followed by water rinsing, a chromate treatment, if required, and coating with a guard coat.

(2) A process for producing a surface-blackened steel sheet, which comprises electrolyzing a stel sheet or a plated steel sheet as a cathode in an acidic aqueous solution containing $Zn^{2+}$, at least one of $Fe^{2+}$, $Co^{2+}$ and $Ni^{2+}$, a film-improving ion consisting of at least one member selected from the group consisting of $Cr^{3+}$, $Fe^{2+}$, $Pb^{2+}$, $In^{2+}$, $Ag^{2+}$, $Sn^{2+}$, $Ti^{2+}$, $Al^{3+}$, $Cu^{2+}$, $Mo^{6+}$, $V^{3+}$, $V^{6+}$, $Mn^{2+}$, $Mn^{4+}$, $Mn^{6+}$, $Bi^{2+}$, sulfite ion, thiosulfate ion, thiocyanate ion, sulfamate ion and sulfonate ion, an oxidizing ion and an organic hydroxycompound as main components, thereby forming a black film on the steel sheet, followed by water rinsing, a chromate treatment, if required, and coating with a guard coat.

(3) A process for producing a surface-blackened steel sheet as described in the foregoing items (1) and (2), wherein at least one of sulfonic acid compound of phenol, naphthol and cresol systems is used as the organic hydrooxycompound.

DETAILED DESCRIPTION OF THE INVENTION

The present process for producing a surface-blackened steel sheet will be described in detail below. According to the present invention, the treating bath is an aqueous solution containing $Zn^{2+}$ as an essential component, at least one metal ion selected from $Fe^{2+}$, $Co^{2+}$ and $Ni^{2+}$, and further an oxidizing ion and an organic hydroxycompound as main components. The metal ion ($Zn^{2+}$, $Fe^{2+}$, $Co^{2+}$, ($Ni^{2+}$) provided in the form of sulfate, chloride, sulfamate, metal, hydroxide, oxide and/or carbonate. The metal may be automatically supplied from an electrode.

$Zn^{2+}$ is one of the main components and is incorporated into the film and is a blackening component, and at the same time, $Zn^{2+}$ suppresses generation of hydrogen gas and contributes to formation of uniform appearance. At least one metal ion selected from $Fe^{2+}$, $Co^{2+}$, and $Ni^{2+}$ is an important component that deposits a compact black film of high density. When only $Zn^{2+}$ is used, a black film is hardly obtained and, even if obtained, an unstable, rough film is liable to form, which film is discolored through reaction with a chromate and a guard coat.

The concentration of $Zn^{2+}$ is 50 to 300 g/l in terms of a sulfate and that of each of other metal ion ($Fe^{2+}$, $Co^{2+}$ and $Ni^{2+}$) is 50 to 300 g/l in terms of a sulfate. A preferable range for the concentration of $Zn^{2+}$ is 100 to 200 g/l in terms of a sulfate and a preferable range of $Zn^{2+}/Ni^{2+}$, $Zn^{2+}/Fe^{2+}$ and $Zn^{2+}/Co^{2+}$ is 1/1 to ½ in terms of a sulfate form ratio. When the sulfate form-/ratio is 1/(less than 1.0), the black film thus obtained is liable to discolor in successive steps, for example, through reaction with a guard coat and a chromate. On the other hand, when it is 1/(more than 2.0), an uneven appearance is liable to form by the generated hydrogen gas or by the flow rate.

The higher the concentration of the metal ion, the easier the formation of a uniform black film. When the concentration is too high, troubles such as drag-out of the solution, deposition of salt, etc. are liable to appear. Thus, the above-mentioned range is preferable.

Since no black film can be obtained at all only by use of the metal ion, the oxidizing ion/and/organic hydroxy-compound are required, as will be given below. The oxidizing ion is a component that oxidizes a part of the metal (Zn, Fe, Co and Ni) deposited by reduction at the cathode to electrically deposit a black complex plating as a hydrated oxide. The organic hydroxycompound is ion and it inhibits the oxidation of polyvalent metal ion (which is a general term for $Cr^{3+}$, $Cr^{6+}$, $Fe^{2}$, $Fe^{3+}$ and the like) at the anode, and when a part of the polyvalent metal ion is oxidized at the anode, the organic hydroxycompound reduces the oxidized part. By so doing, the organic hydroxycompound attains the blackening more effectively and improves uniformization, color tone and tight adhesion of the black film. Particularly, when $Cr^{3+}$ is added to the treating bath, the organic hydroxycompund is effective for the suppression and reduction of $Cr^{6+}$ formed at the anode.

As for preferable oxidizing ion, there are $NO_3^-$, $NO_2^-$, $ClO_4^-$ and $ClO_3^-$. Above all, $NO_3^-$ is liable to form a black film in the most stable state. The oxidizing ion is provided in the form of metallic salt and/or ammonium salt such as, for example, $NaNO_2$, $KNO^3$, $NH_4NO_3$, $Zn(NO_3)_2$, $Ni(NO_3)_2$, $NaNO_2$, $NaClO_4$, $NaClO_3$ and the like. As for the concentration, at least one of $NO_3^-$, $NO_2^-$, $ClO_4^-$ and $ClO_3^-$ is preferable supplied individually or together at 1 to 20 g/l in total in terms of Na salt and the like. Below 1 g/l, the blackness is not satisfactory, whereas above 20 g/l white compounds are liable to deposit on the surface, resulting in an uneven appearance and poor adhesion. This is undesirable.

The black film can be obtained even in the treating bath containing only the above-mentioned $Zn^{2+}$, at least one of $Fe^{2+}$, $Co^{2+}$ and $Ni^{2+}$ and the oxidizing ion, but there is a tendency to make the appearance poor and deteriorate the adhesion due to the polyvalent metal ion oxidized at the anode in a prolonged electrolysis carried out at, for example, a current amount of not less than 2000 coulombs per liter of the solution successively. In order to solve this problem, in the present invention, the organic hydroxycompound is added to the treating bath. The organic hydroxycompound consists of at least one member selected from the group consisting of phenosulfonic acid (PSA), naphtholsulfonic acid (NSA) and cresolsulfonic acid (CSA).

Above all, the most preferable organic hydroxycompound is the one having a sulfonic acid group such as phenolsulfonic acid (PSA), naphtholsulfonic acid (NSA) and cresolsulfonic acid (CSA).

The addition amount of the organic hydroxycompound is 0.1 to 50 g/l, preferably 2 to 20 g/l, in total conconcentration of one kind or not less than two kinds thereof. Below 0.1 g/l, the improvement effect by the organic hydroxycompound is small and is not practical, whereas above 50 g/l, a black film is hardly obtainable and an odor, etc. are generated during the electrolysis, resulting in the deterioration of workability. This is undesirable.

In the present invention, a black steel sheet can be obtained from an aqueous solution containing $Zn^{2+}$ as the first metal ion component, at least one metal ion selected from $Fe^{2+}$, $Co^{2+}$ and $Ni^{2+}$ as the second metal ion component, and the oxidizing ion and the organic hydroxycompound, but a black steel sheet of higher quality can be obtained by adding metal ion and/or anion derived from sulfur compound as the third component.

The metal ion and anion as the third component will be hereinafter referred to as film-improving ion. The film-improving ion consists of at least one member selected from the group consisting of $Cr^{3+}$, $Fe^{2+}$, $Pb^{2+}$, $In^{2+}$, $Ag^{2+}$, $Sn^{2+}$, $Ti^{2+}$, $Al^{3+}$, $Cu^{2+}$, $Mo^{6+}$, $V^{3+}$, $V^{6+}$, $Mn^{2+}$, $Mn^{4+}$, $Mn^{6+}$, $Bi^{2+}$, sulfite ion, thiosulfate ion, thiocyanate ion, sulfamate ion and sulfonation, and particularly, $Cr^{3+}$ and/or $Fe^{2+}$ are effectively used in the present invention. When $Cr^{3+}$ is added to the treating bath, $Cr^{6+}$ is formed at the anode so that the deposition of the black film is suppressed. Thus, the concentration of $C^{6+}$ must be limited to not more than 0.5 g/l. $Fe^{2+}$ has a function as the second metal ion component for the blackening and a further function as a film-improving ion. The film-improving ion has the following effects.

After the formation of black film, a chromate treatment is applied, if necessary, and a black product is produced by coating with a guard coat in the present invention. When the black film is obtained from an aqueous solution containing the film-improving ion, the film-improving ion is turned into a eutectoid state as metal or compound in the film, and a black steel sheet of better adhesion with a more black appearance can be obtained through reaction of the metal or compound in the eutectoid state with the chromate and guard coat. Particularly, when an emulsion containing a hydrophilic resin (for example, olefin acrylic resin, ethyleneimine acrylic resin, polyurethane resin, acrylic ester resin epoxy resin, etc.) as the main component is used as the guard coat, a better result can be obtained through its reaction of the hydrophilic groups (carboxy group, hydroxyl group, amine group, etc.) in the resin structure.

The concentration of the film-improving ion is within a range of 0.01 to 10 g/l in terms of $Cr^{3+}$ in case of $Cr^{3+}$, 1 to 20 g/l in terms of $Fe^{2+}$ in case of $Fe^{2+}$ and 0.001 to 1 gl/l in terms of each metal ion in case of other metal ions. Particularly, use of $Cr^{3+}$ and/or $Fe^{2+}$ is effective. Anion composed of sulfur compound is used within a range of 0.1 to 10 g/l in terms of sodium salt in total concentration of one kind or not less than two kinds thereof.

The bath for use in the present invention contains the organic hydroxycompound. $Cr^{3+}$ and $Fe^{2+}$ as the above-mentioned film-improving ion are oxidized to $Cr^{6+}$ and $Fe^{3+}$ at the anode, giving an adverse effect on the black film. The organic hydroxycompound has a reducing action and suppresses the oxidizatio of metal ion or reduce polyvalent ion into lower-valent one at the anode. Thus, $Cr^{3+}$ and $Fe^{2+}$ can be effectively used.

The pH of the aqueous solution is preferable in a range of 1.5 to 4.0. In the present invention, a black surface can be obtained in a very wide pH range of, for example,0.7 to 6.0, but the above-mentioned pH range is preferable in view of the qualities of the black film obtained such as the adhesion, weldability and the bath concentration control. Bath temperature ranging from 20° to 80° C. is found preferable for production of a good black film.

In the present invention, other compounds can be added, if necessary, for the following purposes. Various supporting salts for improving electroconductivity of the solution, for example, sodium sulfate, ammonium sulfate, potassium sulfate, sodium chloride, ammonium chloride and sulfamic acid; borate, phosphate and phthalate, as a pH buffer agent; polymers for improving the adhesion and workability; and a trace amount of phosphates or chromic acid for improving the rust proofness and adhesion to the guard coat can be added, if required. By using an inorganic sol compound such as silica sol, alumina sol, zirconia sol and titania sol and a cationic polymer such as polyamine sulfone together, it is possible to improve the throwing power of electrodeposition film to stabilize the black film. A chelating agent for the prevention of precipitation such as citric acid, EDTA and oxalic acid, a polymer capable of giving a smoothness to the formed zinc complex plating film such as polyacrylamide, polyethylene glycol and condensed phosphoric acid compound, a chloride capable of improving the smoothness such as sodium chloride potassium chloride and ammonium chloride, a fluorine compound capable of improving the smoothness such as sodium silicofluoride, ammonium borofluoride, etc. can be added, if required.

The electrolytic conditions will be explained below.

The present invention provides a very distinguished process for producing a surface-blackened steel sheet for a shorter time under blackening conditions selected from a wider range, as compared with the conventional process. The current density is desirably 1 to 50 A/dm$^2$. Below 1 A/dm$^2$, coloring is difficult to take place, whereas above 50 A/dm$^2$ a hydrogen gas is generated and there is a high risk of occurrences of unevenness and defilming. A good black film can be obtained at a current quantity of 5 to 100 coulomb/dm$^2$. Below 5 coulomb/dm$^2$, coloring is difficult to take place so that uneven appearance is apt to occur, whereas above 100 coulomb/dm$^2$, uneven appearnce is liable to occur due to the generation of hydrogen gas. Preferable electrolytic conditions are a current density of 5 to 30 A/dm$^2$ and a current quantity of 20 to 50 coulomb/dm$^2$.

As a result of applying the present invention to a cold rolled steel sheet, an electrogalvanized steel sheet, a zinc alloy electroplated steel sheet, a hot dip galvannealed steel sheet, a hot dip zinc alloy plated steel sheet, a galvanealed steel sheet, a lustrous galvanized steel sheet, a tin plated steel sheet, an aluminum plated steel sheet, etc., all the surfaces have been colored and in case of black color, a cold rolled steel sheet and a zinc alloy (Zn-Ni or Zn-Fe) electroplated steel sheet have been found superior in the blackness and less scratching.

By the afore-mentioned treatments, a steel sheet having a black film can be obtained. Furthermore, by coating with a guard coat or by conducting chromate treatment and subsequently coating with a guard coat, an appearance of higher grade and distinguished properties can be obtained.

The guard coat is directed to improvement of the qualities. For example, the uniformity of the appearance can be improved and the coloring degree can be increased by coating with a guard coat. As for the luster, a steel sheet having an appearance ranging from semi-luster to full luster can be obtained by adjusting the type and thickness of a guard coat and the surface roughness of a steel sheet. The scratch-resistance can be also improved thereby. Higher press workability and bending workability can be also obtained thereby and the guard coat is particularly effective against the scratch during the pressing or handling. A large effect can be also obtained against the corrosion resistance.

The guard coat for use in the present invention includes (1) a resin film, (2) an inorganic polymer film, (3) a composite(complex/film of resin and inorganic polymer, and (4) oil, fat, and wax.

The deposition amount of the guard coat must be selected so as not to impair the appearance and weldability, the deposition amount is 0.1 to 3 g/m$^2$, preferably 0.5 to 1.5 g/m$^2$.

As for the resin film (organic copolymer film) for the guard coat, there are a film obtained by coating a water-soluble or water-dispersible or solvent-soluble organic polymer compound (for example, olefine acrylic resin, ethyleneimine acrylic acid, urethane epoxy resin, acrylic ester resin, acrylamide resin and urethane resin) containing a curing agent, if required, and by curing by baking, etc. or by ultraviolet rays; a composite film obtained by coating a composite polymer containing an inorganic compound and an organic compound together (for example, an emulsion composed of silica sol and polyethyleneacrylic resin on the market, an emulsion composed of commercially available ethyleneimine acrylic acid and silica sol, an emulsion composed of commercially available urethan resin and silica sol, a clear coating material composed of silica and epoxy resin of organic solvent type, a clear coating material prepared by dispersing silica in polyester resin and coating materials prepared by adding carbon to these emulsions) containing a curing agent, if necessary, and curing by baking, etc.

As for a compound added as a component of the composite polymer, there are fine oxide such as silica, titania, alumina, zirconia, etc. preferably their sol; inorganic compound such as mica, talc, phosphate, borate and chromate; organic compound such as fatty acid soaps, carbon, fatty acid ester, plastic particle; organometallic compound such as silane coupling agent, titanium coupling agent, etc.; wax; and teflon powder and the like. As will be described later, since the guard coat has a small thickness, the compound added as a component of the composite polymer preferably have finer particle sizes such as 1 to 100 nm as fine as possible and the compound must be dispersed uniformly in the resin.

As for the inorganic polymer, there are silicate compound prepared by making a simple substance or sol of potassium silicate, ammonium silicate, sodium silicate and lithium silicate, composite; condensed phosphoric acid polymer such as, for example, tripolyphosphate and hexametaphosphate compound; biphosphate; and zirconic acid polymers such as ammonium zirconyl carbonate and zirconium acetate.

As for the oil, fat and wax, known ones can be used.

Because the thickness of each of the colored complex plating film and guard coat of the surface-blackened steel sheet of the present invention is small, the present surface-blackened steel sheet can have an appearance and quality fully reflecting the surface state of substrate metal, for example, luster and roughness.

In the present invention, the surface-blackened steel obtained by the surface-blackening treatment in a blackening treatment solution containing $Cr^{3+}$ can have thoroughly distinguished properties only by coating with a guard coat, but optimum quality can be obtained by water rinsing and a chromate treatment after the blackening treatment and before coating with a guard coat.

As the chromate treatment, a coating-drying-type coating chromate treatment, a reaction chromate treatment requiring water washing after dipping or spraying, and a electrolysis chromate treatment can be used. The coating chormate treatment is carried out by coating a black film on a steel sheet with an aqueous solution containing water-soluble $Cr^{3+}$ and $Cr^{6+}$ compounds, preferably an aqueous solution containing chromic anhydried ($CrO_3$) or chromic acid partially reduced to $Cr^{3+}/Cr^{6+}=0.1/0.9$ to $0.5/0.5$ with a reducing agent (reduced chromic acid) or a chromate treating solution of complex components containing the chromic acid solution of $Cr^{3+}$ and $Cr^{6+}$]and, if required, at least one of silica sol, phosphoric acid and organic high polymer compound such as polyacrylic acid, acrylic ester, polyol compound and the like, followed by immediate forced drying of the coated steel sheet at 60° to 100° C.

The deposition amount of chromate is preferably 10 to 200 mg/m$^2$ in terms of Cr.

The reaction chromate treatment can be carried out by treating with a treating solution comprising a commerically available chromic acid compound (for example, the aforementioned reduced chromic acid and chromate) and anionic compound (for example, phosphoric acid, sulfuric acid and nitric acid) and being a low concentration type such that a pH is 1 to 5, followed by water washing and drying.

The electrolysis chromate treatment is carried out by cathodic electrolysis in an aqueous chromic acid solution containing chromic acid and anion such as sulfuric acid, etc. as main components at a pH of 1 to 5, followed by water washing.

In case of the reaction chromate treatment and the electrolysis chromate treatment, it is preferable to use a chromate treating solution having a pH of 1 to 5, preferably 2 to 4, as a bath. In these two cases, the preferable deposition amount is 10 to 100 mg/m$^2$ in terms of Cr.

The effect of quality improvement as in case of coating with a guard coat cannot be expected only by the chromate treatment, and most distinguished surface-blackened steel sheet can be obtained by successive coating of the chromate film with a guard coat.

It is a characteristic of the present invention that the blackness can be more increased by coating with a guard coat containing a hydrophilic resin emulsion above or further by a combination of chromate treatment therewith. Even if the blackness is somewhat unsatisfactory by single blackening treatment, the blackness can be increased by the chromate treatment and coating with a guard coat, and a fully black steel sheet can be obtained. A combination of blackening treatment in the presence of $Cr^{3+}$, chromate treatment and coating with a hydrophilic emulsion-type guard coat can increase the blackness due to interface reaction and such a combination is most preferable.

PREFERRED EMBODIMENTS OF THE INVENTION

EXAMPLE 1

Plated steel strips shown in Table 1 were prepared from cold steel strips by using a Pb anode, then immediately subjected to a blackening treatment also shown in Table 1, then to water rinsing, then to coating with an aqueous solution containing 10 g/l of reduced chromic acid ($Cr^{3+}/Cr^{6+}=4/6$) to a deposition amount of 80 mg/m$^2$ in terms of Cr (as total Cr of $Cr^{3+}$ and $Cr^{6+}$), then to drying and to coating with an emulsion comprising a commercially available acrylic resin (acrylic polyethylene emulsion) and silica sol, which has a grain size of 20 nm, to a thickness of 1 g/m$^2$ (dry basis), followed by baking at a sheet temperature of 120° C., thereby forming a guard coat. Symbols and testing procedures given in Table 1 are as follows:

| | | |
|---|---|---|
| (1) | Organic hydroxycompound: | (PSA): phenolsulphonic acid<br>(CSA): cresolsulfonic acid |
| | $Cr^{3+}$: | A concentration calculated in terms of $Cr^{3+}$ with respect to an aqueous solution added chromium sulfate ($Cr_2(SO_4)_3$). |
| | $Fe^{2+}$: | A concentration calculated in terms of $Fe^{2+}$ with respect to an aqueous solution added iron sulfate ($FeSO_4.7H_2O$) |
| (2) | DK: | Current density (A/dm$^2$) |
| (3) | Q: | Current amount (coulomb/dm$^2$) |
| (4) | L value: | Brightness according to JIS Z 8370, L ≦ 20 is required for blackness, desirably L ≦ 15. |
| | Guard coat: | Complex (composite) film of commercially available acrylic emulsion (acrylic polyethylene emulsion) and silica sol having a grain size of 20 nm; the deposition amount of the film is 1 g/m$^2$. |
| | M-L: | Before coating with the guard coat |
| | T-L: | After coating with the guard coat |
| (5) | Adhesion: | After Erichsen drawing to 7 mm, the black film is subjected to peeling test with a cellophane adhesive tape. The peeled area is evaluated by percentage (%).<br>○: no peeling (= 0%)<br>Δ: peeled (dotwise) (= less than 1%)<br>X: peeled (= more than 5%) |
| (6) | Uniformity: | Evaluation of appearance after the blackening treatment<br>○: uniform and beautiful<br>Δ: somewhat uneven<br>X: uneven |
| (7) | Z-Ni: | 12% Ni—Zn alloy electroplated steel sheet (deposition amount: 15 g/m$^2$) |
| | E-T: | Tin plated steel sheet (deposition amount: 5 g/m$^2$) |
| | E-G: | Zinc electroplated steel sheet (deposition amount: 20 g/m$^2$) |
| | A-S: | Hot dip zinc-iron alloy galvannealed steel sheet (deposition amount: 40 g/m$^2$) |
| | S-Z: | Hot dip 5% Al—Zn alloy plated steel sheet (deposition amount: 60 g/m$^2$) |
| | S-T: | Cold rolled steel sheet |

No. 1 as a comparative example containing no oxidizing ion, where the L value was so high (M-L, 61) that no black appearance was obtained.

No. 2 is a comparative example containing no oxycompound, where the L value after coating with a guard coat was somewhat high (T-L: 17), and thus the black film was peeled dotwise.

Nos. 3 and 4 are examples of the present invention containing PSA as an oxycompound, where both appearance and adhesion were better.

No. 5 is a comparative example, where the adhesion was increased by using a bath containing $Cr^{3+}$ and no oxycompound, but when a current amount amounted to 2000 coulomb per liter of the electrolyte, the appearance was poor.

Nos. 6 to 9 are examples of the present invention containing $Zn^{2+}$, $Ni^{2+}$, $NO_3^-$, $Cr^{3+}$ and PSA as an oxycompound, where when a current amount amounted to 4000 coulomb per liter of the electrolyte, distinguished quality was obtained.

No. 10 is an example of the present invention, in which $Cr^{3+}$ was increased to 1.5 g/l, where the M-L value was somewhat increased, but the T-L Value was low.

No. 11 is an example of the present invention containing $Cr^{3+}$ and $Fe^{2+}$ as the film-improving ion, and No. 12 is an example of the present invention containing cresolsulfonic acid (CSA) and, respectively, where good results were obtained in all these examples.

No. 13 is an example of the present invention at pH 3.5, and No. 14 is an example of the present invention containing 40 g/l of PSA, where the L value was higher in case of No. 14.

Nos. 15, 16 and 17 are examples of the present invention using baths having varied concentrations of oxidizing ion ($NO_3^-$), where a tendency that the L value slightly increases was observed in the baths containing 3 g/l of $NaNO_3$ and 15 g/l of $NaNO_2$, respectively, but good results were obtained in all these examples.

Nos. 18 to 22 are examples of various steel sheets, where all of these steel sheets had a good black appearance.

TABLE 1

| | Blackening-treating bath (g/l) (1) | | | | | | | | |
|---|---|---|---|---|---|---|---|---|---|
| No. | $ZnSO_4.7H_2O$ | $NiSO_4.6H_2O$ | $NaNO_3$ | Organic hydroxy compound | $Cr^{3+}$ | $Fe^{2+}$ | Bath pH | Bath temp. (°C.) | (2) DK ($A/dm^2$) |
| 1 | 150 | 250 | 0 | — | — | — | 3.0 | 40 | 20 |
| 2 | " | " | 5 | — | — | — | " | " | " |
| 3 | " | " | " | (PSA) 5.0 | — | — | " | " | " |
| 4 | " | " | " | (PSA) 10.0 | — | — | " | " | " |
| 5 | " | " | " | (PSA) 0 | 1.0 | — | " | " | " |
| 6 | " | " | " | (PSA) 1.5 | " | — | " | " | " |
| 7 | " | " | " | (PSA) 3.0 | " | — | " | " | " |
| 8 | " | " | " | (PSA) 6.0 | " | — | " | " | " |
| 9 | " | " | " | (PSA) 9.0 | " | — | " | " | " |
| 10 | " | " | " | (PSA) 9.0 | 1.5 | — | " | " | " |
| 11 | " | " | " | (PSA) 9.0 | 1.0 | 1.0 | " | " | " |
| 12 | " | " | " | (CSA) 5.0 | " | " | " | " | " |
| 13 | " | " | " | (PSA) 15.0 | " | " | 3.5 | " | " |
| 14 | " | " | " | (PSA) 40.0 | " | " | 3.5 | " | " |
| 15 | " | " | 3 | (PSA) 5.0 | " | " | 3.5 | " | " |
| 16 | " | " | 10 | (PSA) 5.0 | " | " | 3.0 | " | " |
| 17 | " | " | 15 | (PSA) 5.0 | " | " | " | " | " |
| 18 | " | " | 5 | (PSA) 5.0 | " | " | " | " | " |
| 19 | " | " | " | (PSA) 5.0 | " | " | " | " | " |
| 20 | " | " | " | (PSA) 5.0 | " | " | " | " | " |
| 21 | " | " | " | (PSA) 5.0 | " | " | " | " | " |
| 22 | " | " | " | (PSA) 5.0 | " | " | " | " | " |

| No. | (3) Q (coulomb/$dm^2$) | (4) L value M-L | (4) L value T-L | (5) Adhesion | (6) Uniformity (visual observation) | (7) Steel sheet species | Remarks |
|---|---|---|---|---|---|---|---|
| 1 | 30 | 61 | — | — | — | Z-Ni | Comp. Ex. |
| 2 | " | 12 | 17 | Δ | ○ | " | " |
| 3 | " | 12 | 14 | ○ | ○ | " | The Invention |
| 4 | " | 12 | 14 | ○ | ○ | " | The Invention |
| 5 | " | 19 | 25 | ○ | Δ | " | Comp. Ex. |
| 6 | " | 12 | 14 | ○ | ○ | " | The Invention |
| 7 | " | 12 | 13 | ○ | ○ | " | The Invention |
| 8 | " | 13 | 14 | ○ | ○ | " | The Invention |
| 9 | " | 16 | 15 | ○ | ○ | " | The Invention |
| 10 | " | 18 | 15 | ○ | ○ | " | The Invention |
| 11 | " | 16 | 16 | ○ | ○ | " | The Invention |
| 12 | " | 13 | 15 | ○ | ○ | " | The Invention |
| 13 | " | 13 | 14 | ○ | ○ | " | The Invention |
| 14 | " | 20 | 19 | ○ | ○ | " | The |

TABLE 1-continued

| | | | | | | | |
|---|---|---|---|---|---|---|---|
| | | | | | | | Invention |
| 15 | " | 17 | 15 | ○ | ○ | " | The Invention |
| 16 | " | 12 | 15 | ○ | ○ | " | The Invention |
| 17 | " | 12 | 17 | ○ | ○ | " | The Invention |
| 18 | " | 13 | 14 | ○ | ○ | E-T | The Invention |
| 19 | " | 14 | 16 | ○ | ○ | E-G | The Invention |
| 20 | " | 13 | 15 | ○ | ○ | A-S | The Invention |
| 21 | " | 13 | 15 | ○ | ○ | S-Z | The Invention |
| 22 | " | 13 | 14 | ○ | ○ | S-T | The Invention |

EXAMPLE 2

A base bath containing 5 g/l of phenolsulfonic acid (PSA) and zinc sulfate/nickel sulfate in a ratio of 150/200 g/l at a pH of 3.0 and 40° C. was prepared, and then 5 g/l of sodium nitrate was added to the base bath, and then the film-improving ion was added thereto in a ratio given in Table 2 in the form of lead acetate (No. 23), indium sulfate (No. 24), chromium sulfate (No. 25),vanadium sulfate (No. 26), bismuth sulfate (No. 27) and manganese sulfate (No. 28), thereby preparing a blackening-treatment bath.

Zinc-nickel (Zn-Ni) alloy plated steel sheet was subjected to a blackening treatment in the balckening-treating bath at a current density (DK) of 10 A/dm$^2$ and a current amount (Q) of 30 coulomb/dm$^2$, thereby resulting in a blackened steel sheet, which was further subjected to a chromate treatment and coating with a guard coat in the same manner as in Example 1. The results of evaluation are shown in Table 2.

TABLE 2

| No. | Film-improving ion (g/l) | M-L | T-L | Adhesion | Uniformity | Remark |
|---|---|---|---|---|---|---|
| 23 | $Cr^{3+}/Pb^{2+}$ = 1/0.1 | 12 | 14 | ○ | ○ | The Invention |
| 24 | $Cr^{3+}/In^{2+}$ = 1/0.2 | 12 | 14 | ○ | ○ | " |
| 25 | $Cr^{3+}/Cr^{6+}$ = 1/0.05 | 13 | 17 | ○ | ○ | " |
| 26 | $Cr^{3+}/V^{3+}$ = 1/0.1 | 12 | 14 | ○ | ○ | " |
| 27 | $Cr^{3+}/Bi^{2+}$ = 1/0.1 | 12 | 14 | ○ | ○ | " |
| 28 | $Cr^{3+}/Mn^{2+}$ = 1/0.1 | 12 | 14 | ○ | ○ | " |

In Table 2, the amount (g/l) of the film-improving ion is culculated in terms of ion.

No. 23 to 28 are examples of blackening according to the present invention using the treating baths containing 1 g/l of $Cr^{3+}$ and further containing a small amount of $Pb^{2+}$ (lead acetate), $In^{2+}$ (indium sulfate) $Cr^{6+}$, $V^{3+}$, $Bi^{2+}$ or $Mn^{2+}$, where $Cr^{6+}$ had a tendency to slightly increase the T-L value, but good appearance and adhesion were obtained in all of these examples.

EXAMPLE 3

Zinc-nickel alloy plated steel sheet was subjected to cathodic electrolysis in a blackening-treating bath containing 150 g/l of zinc sulfate, 250 g/l of nickel sulfate, 5 g/l of sodium nitrate, 1.0 g/l of $Cr^{3+}$ and compound shown in Table 3 as an organic hydroxycompound at a pH of 3.0, a temperature of 40° C., a current density of 20 A/dm$^2$ and a current amount of 30 coulomb/dm$^2$, then to water washing, to coating with a chromic acid solution containing 10 g/l of reduced chromic acid and 1 g/l of phosphoric acid, followed by dring and then to coating with an emulsion comprising commercially available ethyleneimineacrylic acid/polymer and silica sol to 1 g/m$^2$ (dry basis), followed by baking at a sheet temperature of 120° C.

TABLE 3

| No. | Hydroxy-compound | | M-L | T-L | Adhesion | Uniformity | Remark |
|---|---|---|---|---|---|---|---|
| 29 | PSA | 5 g/l | 13 | 12 | ○ | ○ | The Invention |
| | Polyvinyl alcohol | 0.1 g/l | | | | | |
| 30 | PSA | 5 g/l | 13 | 12 | ○ | ○ | " |
| | Dextrin | 0.1 g/l | | | | | |
| 31 | PSA | 5 g/l | 13 | 12 | ○ | ○ | " |
| | Polyethylene glycol | 0.2 g/l | | | | | |

Nos. 29 to 31 are examples of the present invention using both aromatic hydroxycompound (PSA) and aliphatic hydroxycompound, where good results were obtained.

EXAMPLE 4

Blackening treatment, chromate treatment and coating with a guard coat were carried in the same manner as in Example 1, except that the bath of No. 13 in Example 1 further contained 0.5 g/l of sodium sulfite (No. 32 in Table 4) and the bath of No. 13 in Example 1 further contained 0 0.5 g/l of sodium thiocyanate (No. 33 in Table 4). The thus obtained steel sheets were tested in the same manner as in Example 1, and it was found that the brightness (T-L) after the coating was 12 for No. 32 and 11.2 for No. 33, and thus uniform black appearance was obtained (evaluation mark: ○) and also good adhesion was obtained (evaluation mark: ○).

TABLE 4

| No. | Film-improving ion | | M-L | T-L | Adhesion | Uniformity | Remark |
|---|---|---|---|---|---|---|---|
| 32 | Sodium sulfite | 0.5 g/l | 13 | 12 | ○ | ○ | The Invention |
| 33 | Sodium thiocyanate | 0.5 g/l | 13 | 11.2 | ○ | ○ | The Invention |

What is claimed is:

1. A process for producing a surface-blackened steel sheet, which comprises electrolyzing a steel sheet or a plated steel sheet as a cathode in an acidic aqueous solution containing $Zn^{2+}$, at least one of $Fe^{2+}$, $Co^{2+}$ and $Ni^{2+}$, an oxidizing ion and at least one organic hydroxy compound selected from group consisting of phenolsulfonic acid, naphtholsulfonic acid and cresolsulfonic acid as main components, thereby forming a black film on the steel sheet, followed by water ringing, subjecting the thus-treated steel sheet to a chromate treatment, if required, and coating with a guard coat.

2. A process according to claim 1, wherein the amount of said hydroxy compound(s) is 0.1 to 50 g/l in total concentration of one member or not less than two members thereof.

3. A process according to claim 1, wherein the amount of said hydroxy compound(s) is 2 to 20 g/l in total concentration of one member or not less than two members thereof.

4. A process according to any one of claims 1 to 3, wherein the oxidizing ion is at least one member selected from the group consisting of $NO_3^-$, $NO_2^-$, $ClO_4^-$ and $ClO_3^-$.

5. A process according to claim 4, wherein the acidic aqueous solution has a pH of 0.7 to 6.0.

6. A process according to claim 4, wherein the acidic aqueous solution has a pH of 1.5 to 4.0

7. A process according to claim 4, wherein the electrolysis is carried out at a current density of 1 to 50 $A/dm^2$ and a current amount of 5 to 100 $coulomb/dm^2$.

8. A process according to claim 4, wherein the electrolysis is carried out at a current density of 5 to 30 $A/dm^2$ and a current amount of 20 to 50 $coulomb/dm^2$.

9. A process according to claim 4, wherein the chromate treatment is carried out in deposition amount of 10 to 200 $mg/m^2$ in terms of Cr.

10. A process according to claim 4, wherein the coating with a guard coat is carried out in a deposition amount of 0.1 to 3 $g/m^2$.

11. A process according to claim 4, wherein the steel sheet or the plated steel sheet is a steel strip or a plated steel strip.

12. A process for producing a surface-blackened steel sheet, which comprises electrolyzing a steel sheet or a plated sheet as a cathode in an acidic aqueous solution containing $Zn^{2+}$, at least one of $Fe^{2+}$, $Co^{2+}$ and $Ni^{2+}$, an oxidizing ion, a film-improving ion consisting of at least one member selected from the group consisting of $Cr^{3+}$, $Fe^{2+}$, $Pb^{2+}$, $In^{2+}$, $Ag^{2+}$, $Sn^{2+}$, $Ti^{2+}$, $Al^{3+}$, $Cu^{2+}$, $Mo^{6+}$, $V^{3+}$, $V^{6+}$, $Mn^{2+}$, $Mn^{4+}$, $Mn^{6+}$, $Bi^{2+}$, a sulfite; ion, a thiosulfate ion, a thiocyanate ion, a sulfamate ion and a sulfonate ion and at least one organic hydroxy compound selected from the group consisting of phenolsulfonic acid, naphtholsulfonic acid and cresolsulfonic acid as main components, thereby forming a black film on the steel sheet, followed by water rinsing, subjecting the thus-treated steel sheet to a chromate treatment, if required, and coating said steel sheet with a guard coat.

13. A process according to claim 12, wherein the amount of said hydroxy compound(s) is 0.1 to 50 g/l in total concentration of one member or not less than two members thereof.

14. A process according to claim 12, wherein the amount of said organic hydroxy compound(s) is 2 to 20 g/l in total concentration of one member or not less than two members thereof.

15. A process according to any one of claims 12 to 14, wherein the oxidizing ion is at least one member selected from the group consisting of $NO_3^-$, $NO_2^-$, $ClO_4^-$ and $ClO_3^-$.

16. A process according to claim 15, wherein the acidic aqueous solution has a pH of 0.7 to 6.0.

17. A process according to claim 15, wherein the acidic aqueous solution has a pH of 1.5 to 4.0.

18. A process according to claim 15, wherein the electrolysis is carried out at a current density of 1 to 50 $A/dm^2$ and a current amount of 5 to 100 $coulomb/dm^2$.

19. A process according to claim 15, wherein the electrolysis is carried out at a current density of 5 to 30 $A/dm^2$ and a current amount of 20 to 50 $coulomb/dm^2$.

20. A process according to claim 15, wherein the chromate treatment is carried out in deposition amount of 10 to 200 $mg/m^2$ in terms of Cr.

21. A process according to claim 15, wherein the coating with a guard coat is carried out in a deposition amount of 0.1 to 3 $g/m^2$.

22. A process according to claim 15, wherein the steel sheet or the plated steel sheet is a steel strip or a plated steel strip.

* * * * *

UNITED STATES PATENT AND TRADEMARK OFFICE

CERTIFICATE OF CORRECTION

PATENT NO. : 5,032,236

DATED : July 16, 1991

INVENTOR(S) : Katsushi SAITOU; Yuujirou MIYAUCHI; Kazumi SHIBATA; Kouichi WADA

It is certified that error appears in the above-identified patent and that said Letters Patent is hereby corrected as shown below:

Claim 1, column 15, line 24, change "ringing" to -- rinsing--.

Claim 12, column 16, line 17, change "sulfite; ion" to -- sulfite ion--.

Signed and Sealed this

Sixteenth Day of March, 1993

*Attest:*

STEPHEN G. KUNIN

*Attesting Officer*

*Acting Commissioner of Patents and Trademarks*